US008202113B2

(12) United States Patent
Sun

(10) Patent No.: US 8,202,113 B2
(45) Date of Patent: Jun. 19, 2012

(54) JUMPER ASSEMBLY

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 14 days.

(21) Appl. No.: 12/952,217

(22) Filed: Nov. 23, 2010

(65) Prior Publication Data

US 2012/0088398 A1 Apr. 12, 2012

(51) Int. Cl.
*H01R 31/08* (2006.01)

(52) U.S. Cl. ..... 439/528; 439/510

(58) Field of Classification Search ..... 439/528, 439/510, 527, 507, 509
See application file for complete search history.

(56) References Cited

U.S. PATENT DOCUMENTS

| | | | | |
|---|---|---|---|---|
| 7,713,083 | B1 * | 5/2010 | Sun et al. | 439/507 |
| 7,798,846 | B2 * | 9/2010 | Yuan | 439/510 |
| 2008/0194138 | A1 * | 8/2008 | Wu et al. | 439/507 |

* cited by examiner

*Primary Examiner* — Gary F. Paumen
(74) *Attorney, Agent, or Firm* — Altis Law Group, Inc.

(57) ABSTRACT

A jumper assembly includes a jumper and a connecting member. An opening is defined in a first end of the jumper, with connected conductive portions installed in the opening. Two spaced hooking holes are defined in a second end of the jumper opposite to the first end. The connecting member is made of insulative material. Two spaced hooks protrude from a first end of the connecting member, to respectively engage in the hooking holes of the jumper. Two spaced inserting holes are defined in a second end of the connecting member opposite to the first end of the connecting member.

3 Claims, 4 Drawing Sheets

JUMPER ASSEMBLY

BACKGROUND

1. Technical Field

The present disclosure relates to a jumper assembly.

2. Description of Related Art

In electronic devices, particularly, computers, jumpers are conductors used to close a break in or bypass part of an electrical circuit. Jumpers are typically used to set up or adjust printed circuit boards, such as the motherboards of the computers. Jumper pins (points to be connected by the jumper) are arranged in groups called jumper blocks, with each group having at least one pair of contact points and often more. In general, each contact in a jumper block terminates in a small metal pin. An appropriately sized conductive sleeve called a jumper, or more technically, a jumper shunt, is slipped over the pins to complete the circuit.

When the jumper is used on the jumper block, two pins of the jumper block are connected to each other to form a closed circuit (ON state). Therefore, current may flow between the two pins. When the jumper is removed, the two pins are an open in the circuit (OFF state). However, once the jumper is removed from the motherboard, the jumper may be lost or misplaced and cannot easily be found because the size of the jumper is very small, which will bring inconvenience to the user.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
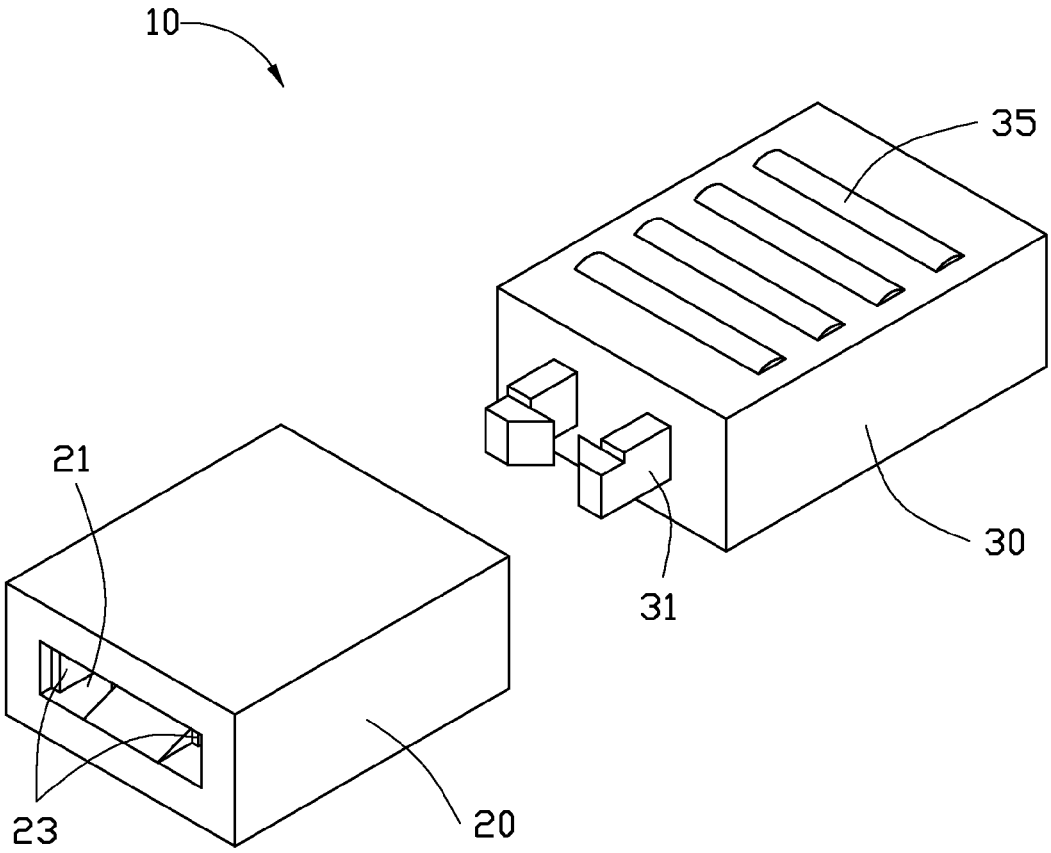
FIG. 1 is an exploded, isometric view of an embodiment of a jumper assembly.
Figure 2:
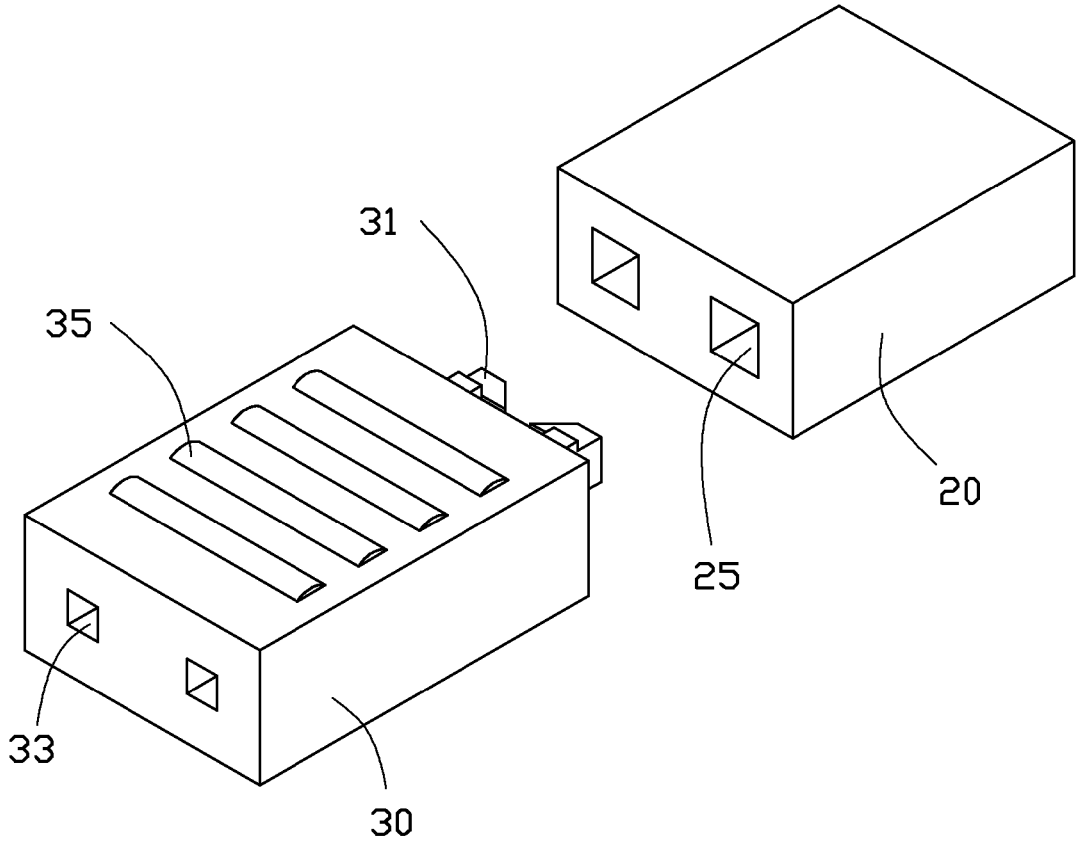
FIG. 2 is a reversed view of the jumper assembly of FIG. 1.
Figure 3:
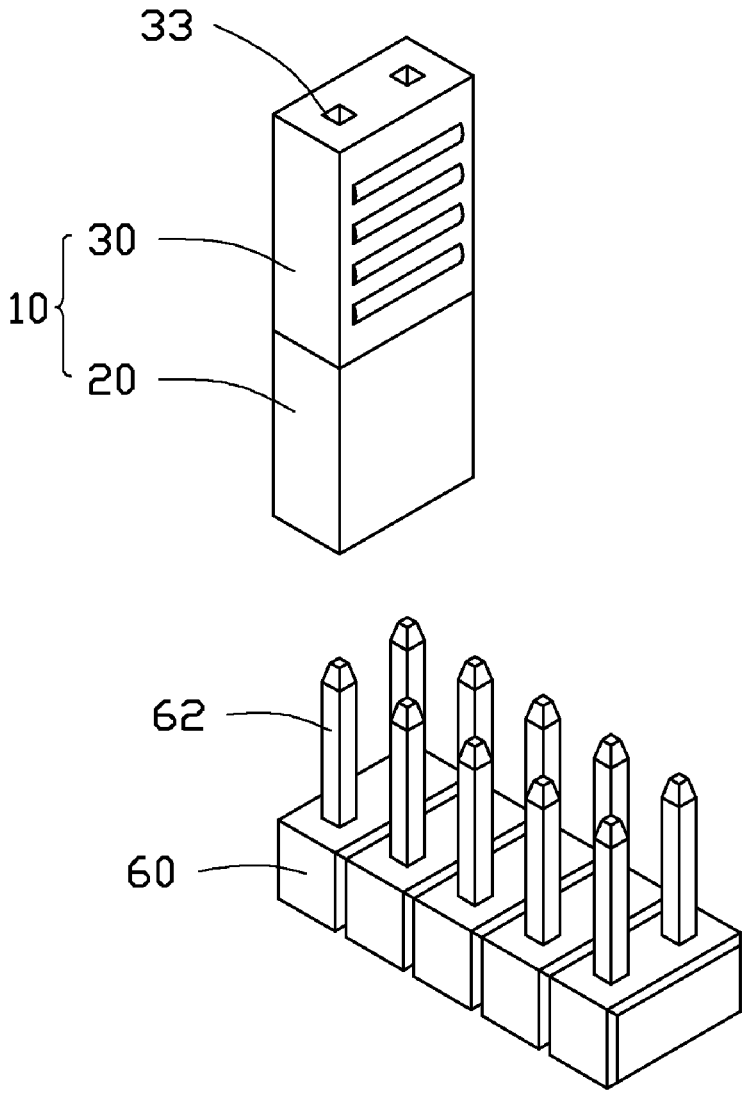
FIG. 3 is an exploded, isometric view of the jumper assembly and a jumper block.

Referring to FIGS. 1 to 3, an embodiment of a jumper assembly 10 includes a jumper 20 and a connecting member 30.

An opening 21 is defined in a first end of the jumper 20, with connected conductive portions 23 installed in the opening 21. Two spaced hooking holes 25 are defined in a second end of the jumper 20 opposite to the first end of the jumper 20.

The connecting member 30 is made of insulated material. Two spaced hooks 31 protrude from a first end of the connecting member 30. Two spaced inserting holes 33 are defined in a second end of the connecting member 30 opposite to the first end of the connecting member 30. A plurality of protrusions 35 is formed on lateral sides of the connecting member 30, to provide grip assistance for easier assembly and disassembly.

In assembly, the hooks 31 of the connecting member 30 are inserted into the hooking holes 25 of the jumper 20, thereby the connecting member 30 is connected to the jumper 20, and the jumper assembly 10 is assembled.

Figure 4:
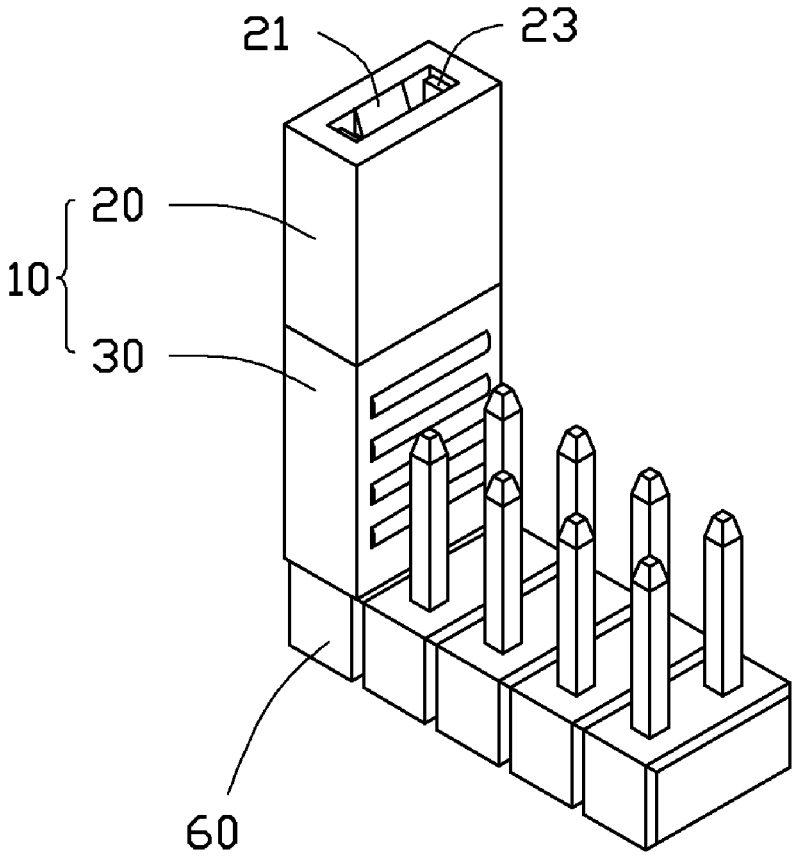
FIG. 4 is an assembled, isometric view of FIG. 3.

Referring to FIGS. 3 and 4, in use, when two adjacent jumper pins 62 of a jumper block 60 need to be connected together to form a closed circuit (ON state), the jumper assembly 10 is installed with the two adjacent jumper pins 62 received into the opening 21 of the jumper 20, and the conductive portions 23 in the opening 21 respectively contact the two adjacent jumper pins 62. Thereby, the two adjacent jumper pins 62 are electrically connected.

When the two adjacent jumper pins 62 need to be disconnected (OFF state), the jumper assembly 10 is moved up and inverted, and the two adjacent jumper pins 62 are respectively received into the inserting holes 33 of the connecting member 30. Because the connecting member 30 is made of insulative material, the two adjacent jumper pins 62 are disconnected. The jumper 20 is mechanically connected without being electrically connected to the jumper block 60 together with the connecting member 30, and will not be lost.

In other embodiments, outer surfaces of the jumper 20 and the connecting member 30 can be visually coded (for example different colors).

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A jumper assembly comprising:

a jumper defining an opening in a first end of the jumper, with connected conductive portions installed in the opening, and two spaced hooking holes in a second end of the jumper opposite to the first end of the jumper; and a connecting member made of insulative material, two spaced hooks protruding from a first end of the connecting member, to respectively engage in the hooking holes of the jumper, and two spaced inserting holes defined in a second end of the connecting member opposite to the first end of the connecting member.

2. The jumper assembly of claim 1, wherein a plurality of protrusions is formed on lateral sides of the connecting member.

3. The jumper assembly of claim 1, wherein outer surfaces of the jumper and the connecting member are visually coded.

* * * * *